US009886916B2

(12) United States Patent
Ko et al.

(10) Patent No.: US 9,886,916 B2
(45) Date of Patent: Feb. 6, 2018

(54) DISPLAY DEVICE INCLUDING A DYNAMIC CAPACITANCE COMPENSATION LOOKUP TABLE

(71) Applicant: Samsung Display Co., Ltd., Yongin (KR)

(72) Inventors: Hyun-Seok Ko, Yongin-si (KR); Jin Kyu Park, Seongnam-si (KR); Whee Won Lee, Busan (KR); Sang Su Han, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 121 days.

(21) Appl. No.: 14/732,900

(22) Filed: Jun. 8, 2015

(65) Prior Publication Data

US 2016/0189684 A1 Jun. 30, 2016

(30) Foreign Application Priority Data

Dec. 29, 2014 (KR) ..... 10-2014-0192022

(51) Int. Cl.
*G09G 3/36* (2006.01)
*G09G 3/20* (2006.01)
(Continued)

(52) U.S. Cl.
CPC ..... *G09G 3/36* (2013.01); *G09G 3/2096* (2013.01); *G09G 5/006* (2013.01); *G09G 5/363* (2013.01);
(Continued)

(58) Field of Classification Search
CPC ..... G09G 3/36; G09G 3/2096; G09G 5/006; G09G 5/363; G09G 2370/047;
(Continued)

(56) References Cited

U.S. PATENT DOCUMENTS 8,681,164 B2 3/2014 Owen et al.
2006/0044242 A1* 3/2006 Park ..... G09G 3/3648 345/89
(Continued)

FOREIGN PATENT DOCUMENTS

KR 10-2005-0013865 2/2005
KR 10-2014-0037309 3/2014

*Primary Examiner* — Aneeta Yodichkas
(74) *Attorney, Agent, or Firm* — H.C. Park & Associates, PLC

(57) ABSTRACT

A display device includes an external image processing set and a display assembly configured to receive converted image data from the external image processing set and display an image corresponding to the converted image data. The display assembly includes a dynamic capacitance compensation lookup table storage unit which stores therein a dynamic capacitance compensation lookup table, and the external image processing set includes a memory which receives the dynamic capacitance compensation lookup table from the display assembly and stores therein the received dynamic capacitance compensation lookup table, and a graphic processing unit which outputs converted image data in which current frame data has undergone dynamic capacitance compensation based on the stored dynamic capacitance compensation lookup table, the current frame data and previous frame data.

16 Claims, 11 Drawing Sheets

(51) Int. Cl.
*G09G 5/00* (2006.01)
*G09G 5/36* (2006.01)

(52) U.S. Cl.
CPC ..... *G09G 2310/0248* (2013.01); *G09G 2320/0223* (2013.01); *G09G 2320/0252* (2013.01); *G09G 2320/0285* (2013.01); *G09G 2370/047* (2013.01)

(58) Field of Classification Search
CPC ... G09G 2320/0223; G09G 2320/0252; G09G 2320/0285; G09G 2310/0248
See application file for complete search history.

(56) References Cited

U.S. PATENT DOCUMENTS

| | | | | |
|---|---|---|---|---|
| 2008/0084432 | A1* | 4/2008 | Jeon | G09G 3/3611 345/690 |
| 2010/0134401 | A1 | 6/2010 | Shin et al. | |
| 2010/0165222 | A1* | 7/2010 | Choi | G09G 3/3648 349/15 |
| 2013/0002653 | A1 | 1/2013 | Lee et al. | |
| 2013/0094754 | A1* | 4/2013 | Lee | G09G 5/003 382/154 |
| 2013/0155129 | A1 | 6/2013 | Park et al. | |
| 2014/0104324 | A1 | 4/2014 | Park et al. | |
| 2014/0111564 | A1 | 4/2014 | Jeon et al. | |

* cited by examiner

FIG. 5

$M_{0_64}$

| | | GRAY LEVEL VALUE OF PREVIOUS FRAME | | | |
|---|---|---|---|---|---|
| | | 0 | 64 | | 1024 |
| GRAY LEVEL VALUE OF CURRENT FRAME | 0 | 0 | 0 | | 0 |
| | 64 | 85 | 64 | | 0 |
| | | | | | |
| | 1024 | 1023 | | | 1023 |

DISPLAY DEVICE INCLUDING A DYNAMIC CAPACITANCE COMPENSATION LOOKUP TABLE

CROSS REFERENCE TO RELATED APPLICATION

This application claims priority from and the benefit of Korean Patent Application No. 10-2014-0192022, filed on Dec. 29, 2014, which is hereby incorporated by reference for all purposes as if fully set forth herein.

BACKGROUND

Field

The present invention relates to a display device, and more particularly, to a display device with improved display quality.

Discussion of the Background

Recently, demand for lighter and thinner monitors, television, portable display devices, and the like have been on the rise. Because of this demand, existing cathode ray tube displays are being replaced by flat panel displays such as liquid crystal displays and organic electroluminescence displays.

Performances of displays used in desktop computers, notebook computers, and portable phones have improved. User expectations for a fast screen response and a high display quality of moving pictures with no trailing afterimage have also grown. To satisfy such expectations, there is a need for flat panel displays having rapid response speed when images are being reproduced from input image data.

Specifically, liquid crystal displays are configured so the intensity of electric field being applied to a liquid crystal material having anisotropic dielectric properties provided between two substrates is controlled to adjust the quantity of light being transmitted through the substrates, thus displaying images. There is a delay time in which liquid crystal material reaches the state corresponding to the intensity of electric field being applied to the liquid crystal material, and such a delay time may cause a degraded response speed of liquid crystal displays.

In order to improve the response speed of a liquid crystal display, a dynamic capacitance compensation (hereinafter, referred to as "DCC") method may be employed. In a DCC method, an over-drive operation for applying an electric field higher or lower than the electric field corresponding to an image is performed. However, the DCC method typically uses a separate frame memory embedded in a driving unit of the liquid crystal display, causing a degraded yield rate and increased cost for the display panel.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the present invention provide a display device having enhanced response speed, thus improving display quality of the display device.

Exemplary embodiments of present invention also provide a driving unit that eliminates use of a frame memory for dynamic capacitance compensation, thus increasing yield rate and reducing cost for the display panel.

Additional features of the invention will be set forth in the description which follows, and in part will be apparent from the description, or may be learned by practice of the invention.

An exemplary embodiment of the present invention discloses a display device including an external image processing set, and a display assembly which receives converted image data from the external image processing set and displays an image corresponding to the converted image data. The display assembly includes a dynamic capacitance compensation lookup table storage unit which stores a dynamic capacitance compensation lookup table. The external image processing set includes a memory which receives the dynamic capacitance compensation lookup table from the display assembly and stores the received dynamic capacitance compensation lookup table, and a graphic processing unit which outputs converted image data in which current frame data has undergone dynamic capacitance compensation based on the stored dynamic capacitance compensation lookup table, the current frame data and previous frame data.

It is to be understood that both the foregoing general description and the following detailed description are exemplary and explanatory and are intended to provide further explanation of the inventive concept as claimed.

BRIEF DESCRIPTION OF THE DRAWINGS

The accompanying drawings, which are included to provide a further understanding of the inventive concept and are incorporated in and constitute a part of this specification, illustrate embodiments of the invention, and together with the description serve to explain the principles of the invention.

FIG. 5 illustrates a DCC LUT according to an exemplary embodiment.

DETAILED DESCRIPTION OF THE ILLUSTRATED EMBODIMENTS

Figure 1:
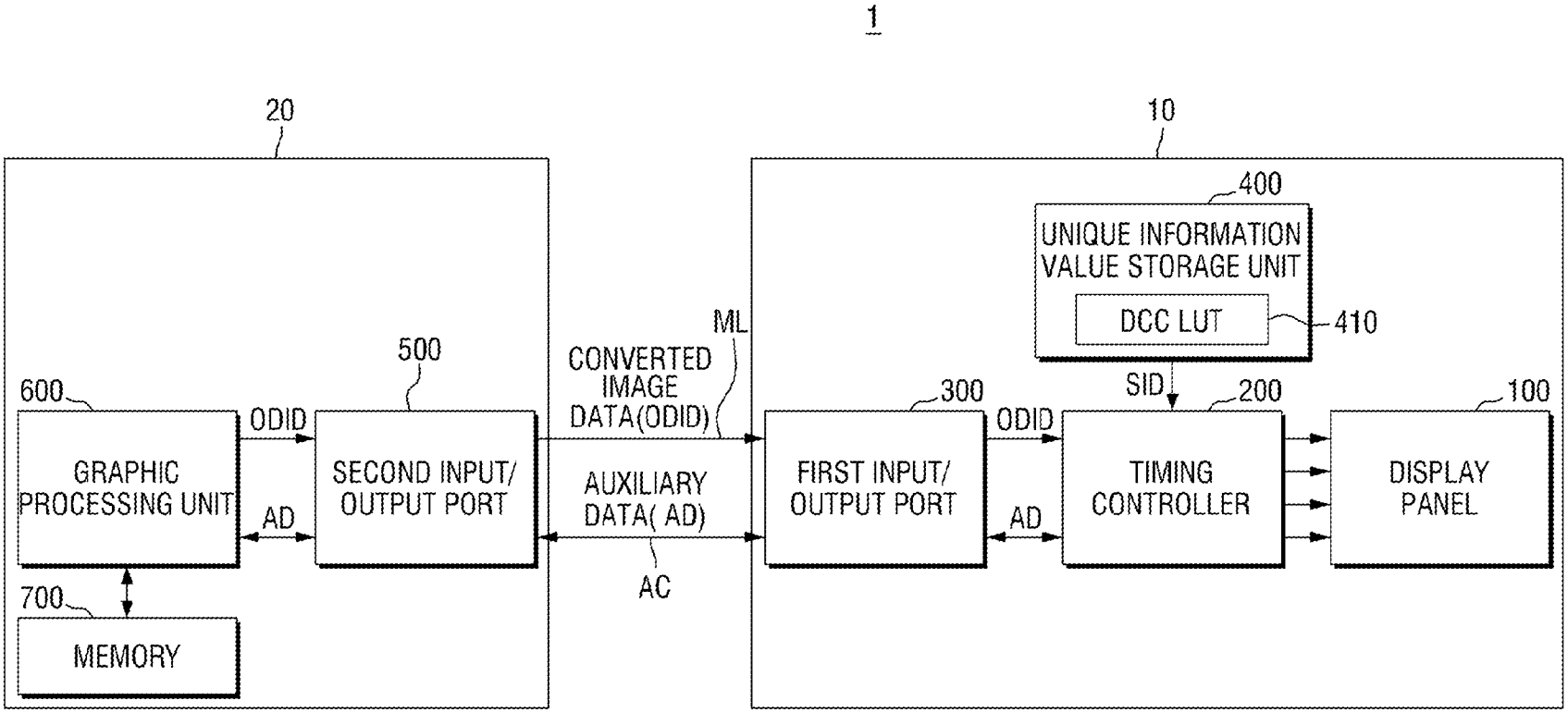
FIG. 1 is a block diagram of a display device according to an exemplary embodiment.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments will be described in detail with reference to the accompanying drawings.

FIG. 1 is a block diagram of a display device according to an exemplary embodiment.

Referring to FIG. 1, a display device 1 according to an exemplary embodiment includes a display assembly 10 and an external image processing set 20.

The display assembly 10 may include a display panel 100, a timing controller 200, a first input/output port 300, and a unique information value storage unit 400. The external image processing set 20 may include a second input/output port 500, a graphic processing unit 600, and a memory 700.

The display assembly 10 and the external image processing set 20 may be connected with each other through a main link ML and an auxiliary channel AC, and display assembly 10 may receive converted image data ODID from the external image processing set 20 through the main link ML and display an image corresponding to the received converted image data ODID onto the display panel 100.

The auxiliary channel AC may be capable of bidirectional communication for transmitting and receiving auxiliary data AD between the external image processing set 20 and the display assembly 10. The auxiliary data AD may be a dynamic capacitance compensation lookup table (DCC LUT) 410 provided from the display panel 100. However, the auxiliary data AD is not limited thereto. For example, the auxiliary data AD may include additional information such as extended display identification data (EDID) which is information on the product type of the display assembly 10, information regarding error identification in the main link ML, information regarding a dimming operation and a frame frequency of a display backlight, and/or information regarding a brightness or power of a display.

Figure 2:
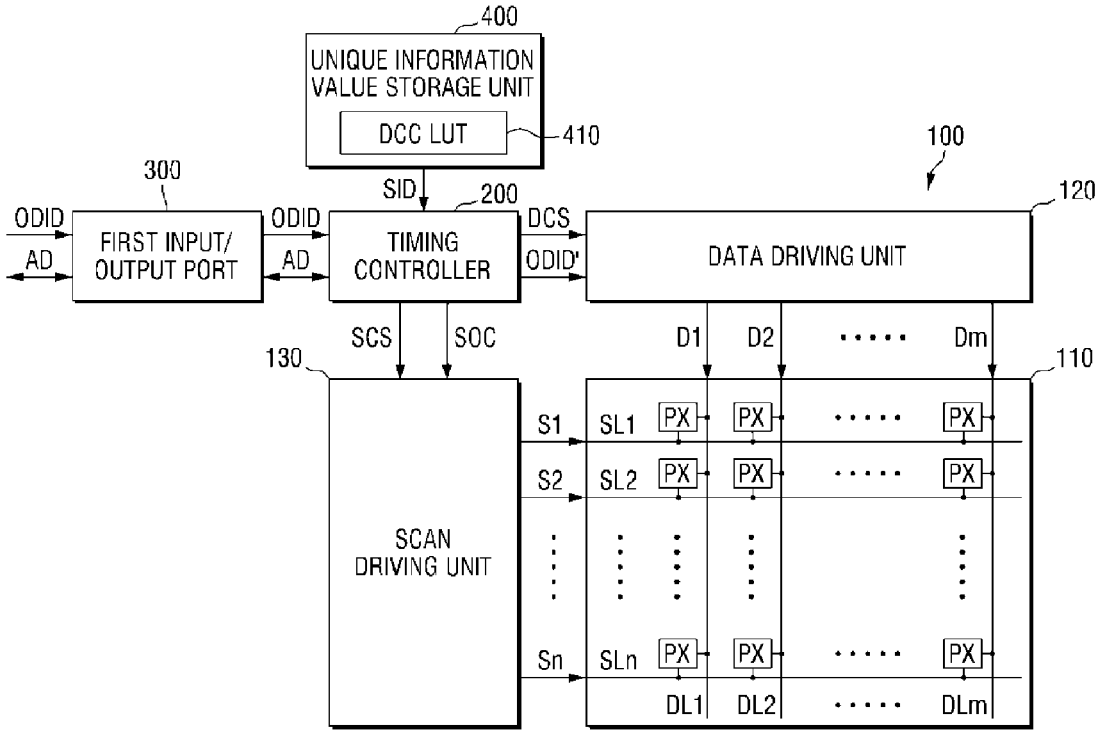
FIG. 2 is a block diagram of a display assembly according to an exemplary embodiment.

Referring to FIG. 2, components of the display assembly 10 will hereinafter be explained in more detail. FIG. 2 is a block diagram of a display assembly according to an exemplary embodiment.

The display assembly 10 according to an exemplary embodiment may include the display panel 100, the timing controller 200, the first input/output port 300, and the unique information value storage unit 400. The display assembly 100 may include a pixel panel 110, a data driving unit 120, and a scan driving unit 130.

The pixel panel 110 may include a plurality of scan lines SL1 to SLn extending in a horizontal direction to transmit scan signals S1 to Sn, a plurality of data lines DL1 to DLm extending in a vertical direction to transmit a plurality of data signals D1 to Dm to a plurality of pixel regions PX in response to the scan signals S1 to Sn of scan lines SL1 to SLn. The plurality of pixel regions PX may be defined by the plurality of scan lines and the plurality of data lines.

The data driving unit 120 may receive processed converted image data ODID' and a data control signal DCS provided from the timing controller 200, and provide the received processed converted image data ODID' and data control signal to the plurality of data lines. Although not shown in FIG. 2, the data driving unit 120 may include a latch circuit and a level shift circuit. The latch circuit may store the processed converted image data ODID' received in series and apply the processed converted image data ODID' to the pixel panel 110 in parallel, and the level shift circuit may adjust the level of an actual voltage being provided to the pixel panel 110 in correspondence to the processed converted image data ODID'.

The scan driving unit 130 may receive a scan control signal SCS provided from the timing controller 200, and apply the plurality of scan signals S1 to Sn to the plurality of scan lines SL1 to SLn. The plurality of scan signals may serve as switches to enable the plurality of data signals D1 to Dm provided through the data lines to be applied to the plurality of pixels PX.

Referring to FIG. 2, the data driving unit 120, the scan driving unit 130, and the pixel panel 110 are shown in separate blocks, however, exemplary embodiments are not limited thereto. For example, the data driving unit 120 and the scan driving unit 130 of exemplary embodiments may be an IC chip provided in at least a portion of the pixel panel 110 or may be a driving circuit directly provided in at least a portion of the pixel panel 110.

The timing controller 200 may process the converted image data ODID received from the external image processing set 20, and transmit the processed converted image data ODID' to the data driving unit 120. The timing controller 200 may output the data control signal DCS and the scan control signal SCS for driving the data driving unit 120 and the scan driving unit 130, respectively, in synchronization with the processed converted image data ODID'. The processed converted image data ODID' may be a value obtained by modulating or compensating the received converted image data ODID based on user preferences or characteristics of a display device. However, exemplary embodiments are not limited thereto, and the timing controller 200 may transmit the converted image data ODID to the data driving unit 120 without processing.

The unique information value storage unit 400 may store therein unique information data SID unique to each display assembly 10 such as information regarding the product specification of the display assembly 10 and information regarding offset value for adjusting the display quality of a display in advance. The unique information value storage unit 400 may include the dynamic capacitance compensation lookup table (DCC LUT) 410 as unique information data SID unique to the display assembly 10. The unique information value storage unit may include other additional information, for example, extended display identification data or the like regarding the product type of the display assembly 10.

The unique information value storage unit 400 may include the nonvolatile memory 700 for storing unique information SID regarding the display assembly 10, and may be, for example, an electrically erasable programmable read-only memory (EEPROM), flash memory, or the like. For the sake of convenience, nonvolatile memory 700 will include flash memory for the remainder of the description. However, the unique information value storage unit 400 according to exemplary embodiments is not limited thereto, and various storage devices which allow for ease of storage and transmission of data can be employed.

The DCC LUT is a lookup table for reference values for over-driving the driving voltage being applied to the plurality of pixels PX so as to compensate for the response speed of the plurality of pixels PX, specifically, liquid crystal pixels of the pixel panel 110. The dynamic capacitance compensation and DCC LUT will be described in detailed later with regards to FIG. 5 and FIG. 6.

The first input/output port 300 is an interface which transmits the converted image data ODID from the external image processing set 20 to the timing controller 200 through the main link ML, and intermediates a bidirectional transmission of the auxiliary data AD between the timing controller 200 and the external image processing set 20 through the auxiliary channel AC. Although the first input/output port 300 is illustrated as a block separated from the timing controller 200 in FIG. 2, exemplary embodiments are not limited thereto. The first input/output port 300 shown in FIG. 2 is an interface which is illustrated merely as a separate block for data transmission/reception between the timing controller 200 and the external image processing set 20, and the first input/output port 300 may be a component representing a part of the timing controller 200. The first input/output port 300 may be a separate component physically discriminated from the timing controller 200, and may be, for example, a port or a terminal which can be connected to and disconnected from a cable connected to the external image processing set 20, and specifically, may be an embedded display port (EDP), a display port (DP), a digital visual interface (DVI) port, or a high definition multimedia interface (HDMI) port. The first input/output port 300 may be an inter-integrated circuit ($I^2C$ or I2C) connector terminal or connecting portion for a bidirectional transmission of the auxiliary channel AC.

Figure 3:
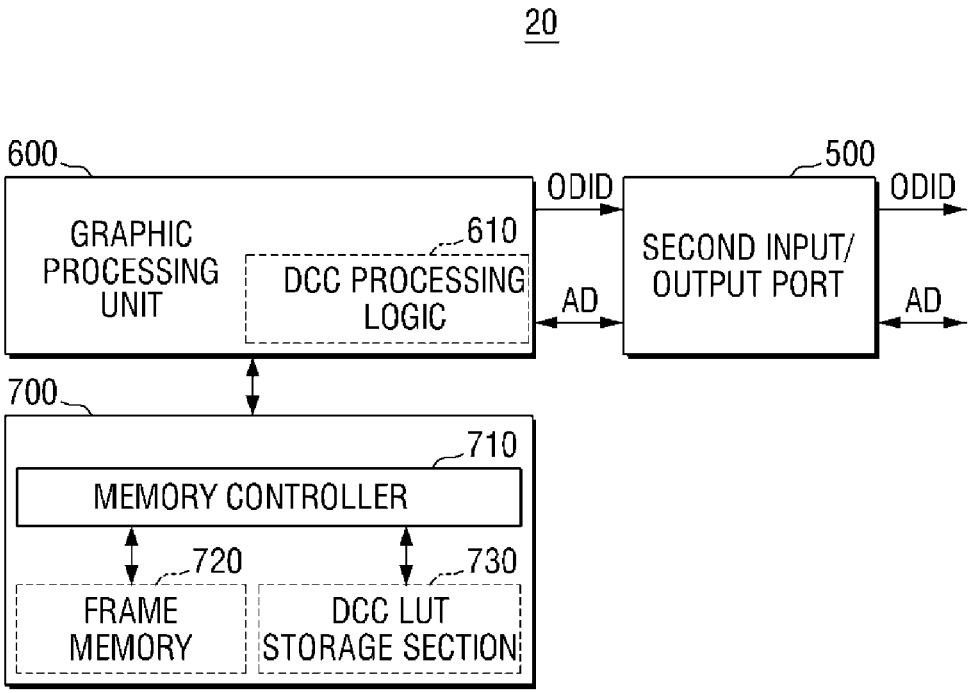
FIG. 3 is a block diagram of an external image processing set according to an exemplary embodiment.

Components of the external image processing set 20 will be explained in more detail with reference to FIG. 3. FIG. 3 is a block diagram of the external image processing set according to an exemplary embodiment.

The external image processing set 20 according to exemplary embodiments include the graphic processing unit 600, the second input/output port 500, and the memory 700.

The external image processing set 20 may be a unit or a module which is arranged outside the display assembly 10 so as to convert data stored in storage media or data provided through streaming into image data appropriate for the display assembly 10.

In this case, being arranged "outside" the display assembly 10 refers to the external image processing set 20 being a separate set or assembly physically discriminated from the display assembly 10. Thus, the external image processing set 20 and the display assembly 10 are connected with each other through a cable. For example, the external image processing set 20 may be a separate device which converts data regarding images stored in storage media or provided through streaming services into image data corresponding to specifications of the display assembly 10, similarly to a graphic card of a personal computer or a set-top box for providing a television image signal.

In general, the graphic processing unit 600 may convert data including images stored in storage media into image data corresponding to display specifications of the display assembly 10. Specifically, the graphic processing unit 600 may be a unit or an integrated circuit providing an algorithm for directly converting data stored in storage media, such as a compact disc, a blue-ray disc, and/or a hard disk, using a unique image storing scheme such as MPEG and AVI, into reproducible image data. The graphic processing unit 600 may convert an image data format processed by another processing device, for example, a central processing device such as a computer or a mobile device, into image data corresponding to standards of a display assembly 10.

The graphic processing unit 600 may further include an algorithm that compensates reproducible image data based on user preferences or characteristics of the display assembly 10. The graphic processing unit 600 according to an exemplary embodiment may include DCC processing logic 610 for processing an algorithm for dynamic capacitance compensation, improving motion picture processing quality of a display.

The memory 700 may temporarily store therein at least one frame of reproducible image data, or may store therein various reference values or reference tables used when the graphic processing unit 600 performs a compensation algorithm for compensating reproducible image data. According to exemplary embodiments, the memory 700 may include at least a frame memory 720, a space or a section allocated to the memory 700 to store the DCC LUT, and a memory controller 710 to perform an allocation of sections in the memory 700. The memory controller 710 may transmit data stored in the memory 700 to the graphic processing unit 600, or receive data from the graphic processing unit 600 and store the received data. The memory 700 may be a volatile memory, for example, DRAM.

The second input/output port 500 is an interface that transmits the converted image data ODID from the external image processing set 20 to the timing controller 200 through the main link ML and the first input/output port 300, and intermediates a bidirectional transmission of the auxiliary data AD between the timing controller 200 and the external image processing set 20 through the auxiliary channel AC. Although the second input/output port 500 is illustrated as a block separated from the graphic processing unit 600 in FIG. 3, exemplary embodiments are not limited thereto. The second input/output port 500 shown in FIG. 3 is an interface which is illustrated merely as a separate block for data transmission/reception between the graphic processing unit 600 and the display assembly 10, and the second input/output port 500 may be a component for performing a part of the graphic processing unit 600. The second input/output port 500 may be a separate component physically discriminated from the graphic processing unit 600, and may be, for example, a port or a terminal which can be connected to and disconnected from a cable connected to the display assembly 10. Specifically, the second input/output port 500 may be an embedded display port (EDP), a display port (DP), a DVI port, or an HDMI port. The second input/output port 500 may be an I2C connector terminal or connecting portion for a bidirectional transmission of the auxiliary channel AC.

Specifically, the DCC LUT 410 is a lookup table which is set with characteristics unique to the individual display assembly 10 reflected to the lookup table, and therefore, the DCC LUT 410 is stored in the unique information value storage unit 400 of the display assembly 10 during an early stage. The DCC LUT may be transmitted to the memory 700 through the first input/output port 300 of the display assembly 10, the auxiliary channel AC, and the second input/output port 500 of the external image processing set 20. The DCC LUT may be stored in a DCC LUT storage section 730 of the memory 700 of the external image processing set 20.

Figure 4:
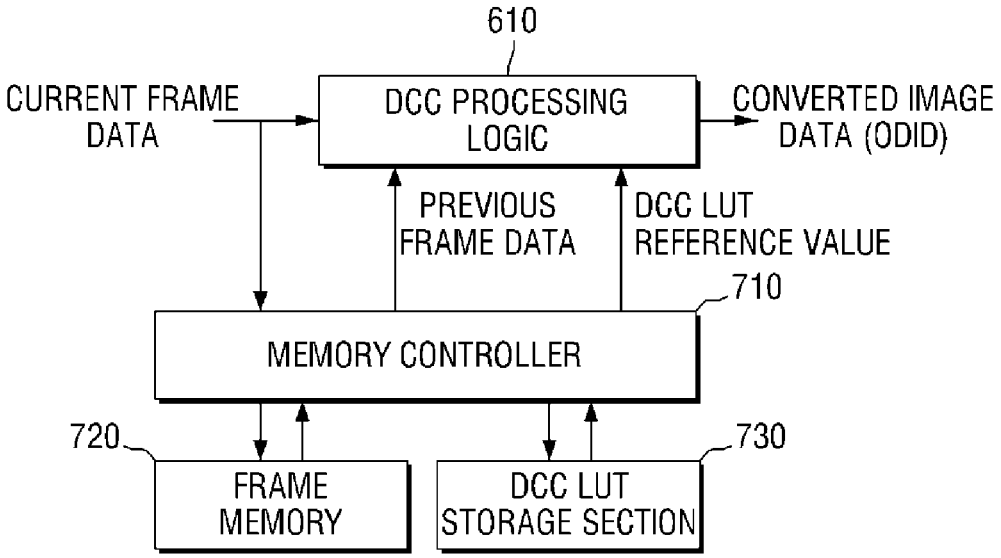
FIG. 4 is a block diagram illustrating a process of performing dynamic capacitance compensation by a graphic processing unit and a memory of the external image processing set according to an exemplary embodiment.

FIG. 4 is a block diagram illustrating a process of performing dynamic capacitance compensation by the graphic processing unit 600 and the memory 700 of the external image processing set 20 according to exemplary embodiments.

Referring to FIG. 4, the DCC processing logic 610 of the graphic processing unit 600 may receive current frame data and previous frame data. The memory controller 710 may receive current frame data and store the received current frame data in the frame memory 720 of the memory 700, and may provide the stored current frame data to the DCC processing logic 610 as previous frame data in the next frame.

The DCC processing logic 610 may receive a DCC LUT reference value and previous frame data from the memory controller 710, and may output converted image data ODID obtained by performing dynamic capacitance compensation on the current frame data based on the current frame data, the previous frame data, and DCC LUT.

FIG. 5 illustrates the DCC LUT according to an exemplary embodiment.

Referring to FIG. 5, the DCC LUT according to an exemplary embodiment may be a lookup table representing, by unit of a gray level value of the previous frame data and a corresponding gray level value of the current frame data, a gray level value of the converted image data ODID in which a dynamic capacitance compensation value is reflected.

Referring to FIG. 5, for example, when the gray level value of the previous frame data is 0 and the gray level value of the current frame data is 64, the converted image data may be a value which is compensated such that the gray level value of the current frame data becomes 85, with reference to the value of $M_{0_64}$ of DCC LUT.

Generally, the degree of the compensation may increase as the difference between the gray level value of the previous frame data and the gray level value of the current frame data becomes larger, and the degree of the compensation may decrease as the difference between the gray level value of the previous frame data and the gray level value of the current frame data becomes smaller.

Figure 6:
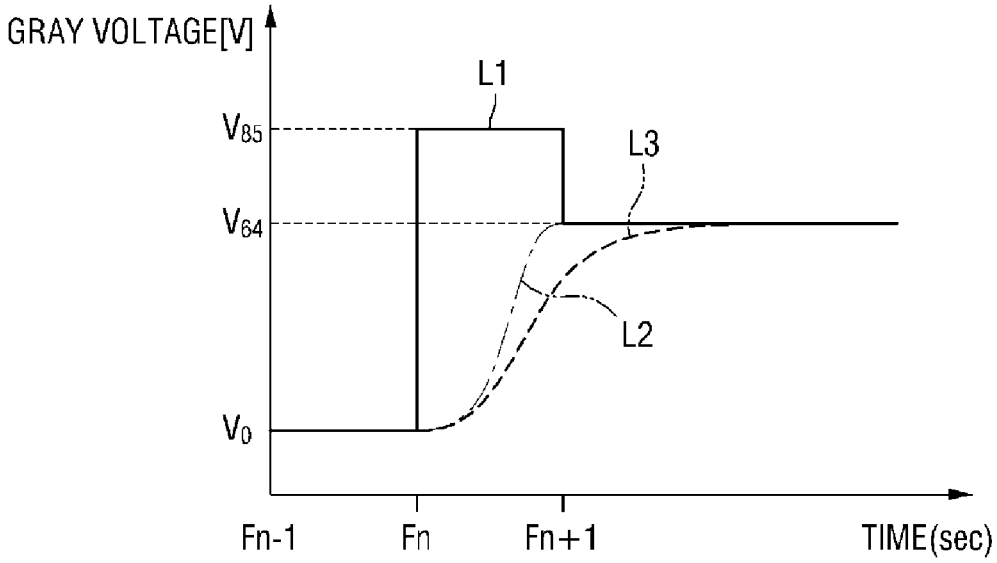
FIG. 6 illustrates an output waveform of converted image data ODID which has undergone dynamic capacitance compensation and a behavior of liquid crystals according to an exemplary embodiment.

FIG. 6 illustrates an output waveform of converted image data ODID which has undergone dynamic capacitance compensation and a behavior of liquid crystals according to an exemplary embodiment.

Referring to FIG. 6, for example, when the gray level value of the previous frame data is 0 and the gray level value of the next frame data is 64, the corresponding gray value voltage of the previous frame data is $V_0$, and the gray value voltage of the current frame data corresponds to $V_{64}$.

At point Fn where the gray voltage of the current frame data is applied, the gray voltage increases from $V_0$ to $V_{64}$, however, the corresponding behavior of liquid crystals may be delayed, and the liquid crystals may not reach the state corresponding to the gray voltage $V_{64}$ at point Fn+1 where the current frame ends. That is, when dynamic capacitance compensation is not performed, liquid crystals may behave like the curve shown as L3 of FIG. 6, which may degrade specifically a motion picture quality.

On the other hand, when the dynamic capacitance compensation is performed according to an exemplary embodiment, the gray voltage $V_{85}$ may be applied at point Fn where the current frame data is applied with reference to $M_{0_64}$ of DCC LUT, and the behavior of liquid crystals may have quicker response characteristics. That is, when the dynamic capacitance compensation is performed, the gray voltage may be applied as shown in L1 of FIG. 6, and liquid crystals may behave like the curve shown as L2, improving the response speed of liquid crystals.

Figure 7:
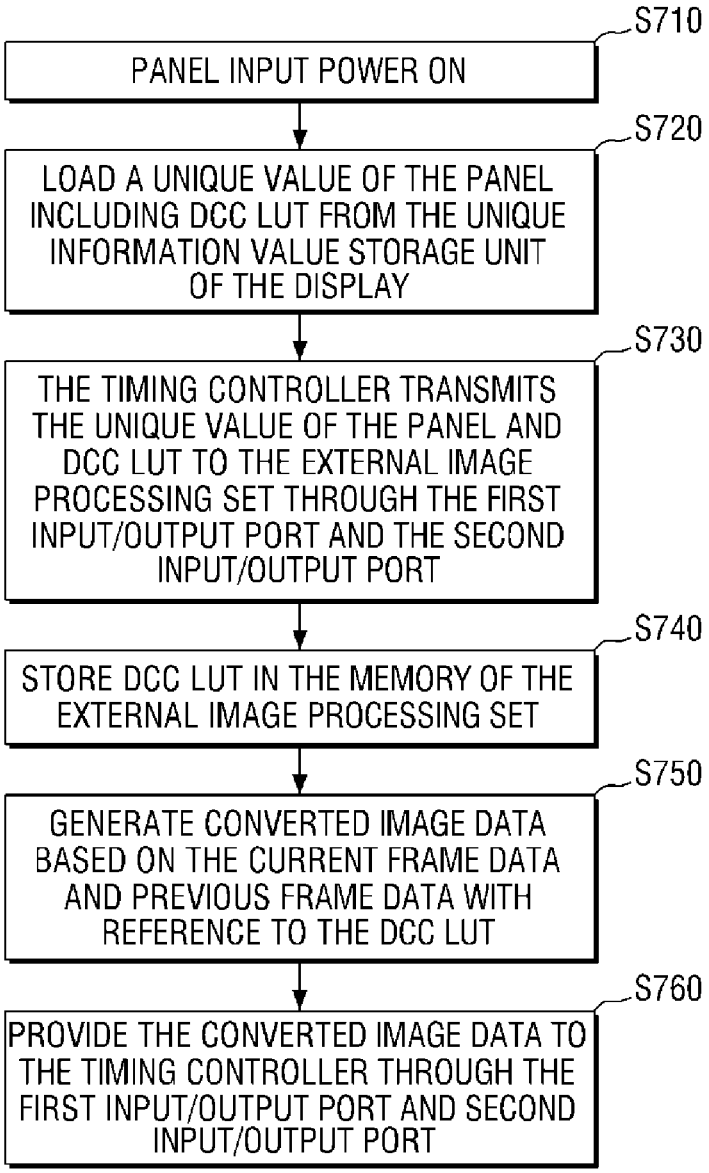
FIG. 7 is a flowchart illustrating an operation of the display device according to an exemplary embodiment.

FIG. 7 is a flow chart illustrating an operation of the display device according to an exemplary embodiment.

Referring to FIG. 7, an operation start signal is generated when power is applied to the external image processing set 20 and the display assembly 10, and an accompanying initialization process for displaying image data may be performed by the display assembly 10 and the external image processing set 20 (S710).

Subsequently, the display assembly 10 may load information including a unique value of the display panel 100 including DCC LUT from the unique information value storage unit 400 (S720).

Subsequently, the timing controller 200 may transmit the unique value of the display panel 100 and DCC LUT to the external image processing set 20 through the first input/output port 300 and the second first input/output port 500 (S730).

Subsequently, the DCC LUT may be stored in the DCC LUT storage section 730 of the memory 700 of the external image processing set 20 (S740).

Subsequently, converted image data ODID may be generated based on the current frame data and previous frame data with reference to the DCC LUT (S750).

Subsequently, the converted image data ODID may be provided to the timing controller 200 through the first input/output port 300 and the second first input/output port 500 so as to display an image which has undergone dynamic capacitance compensation (S760).

Figure 8:
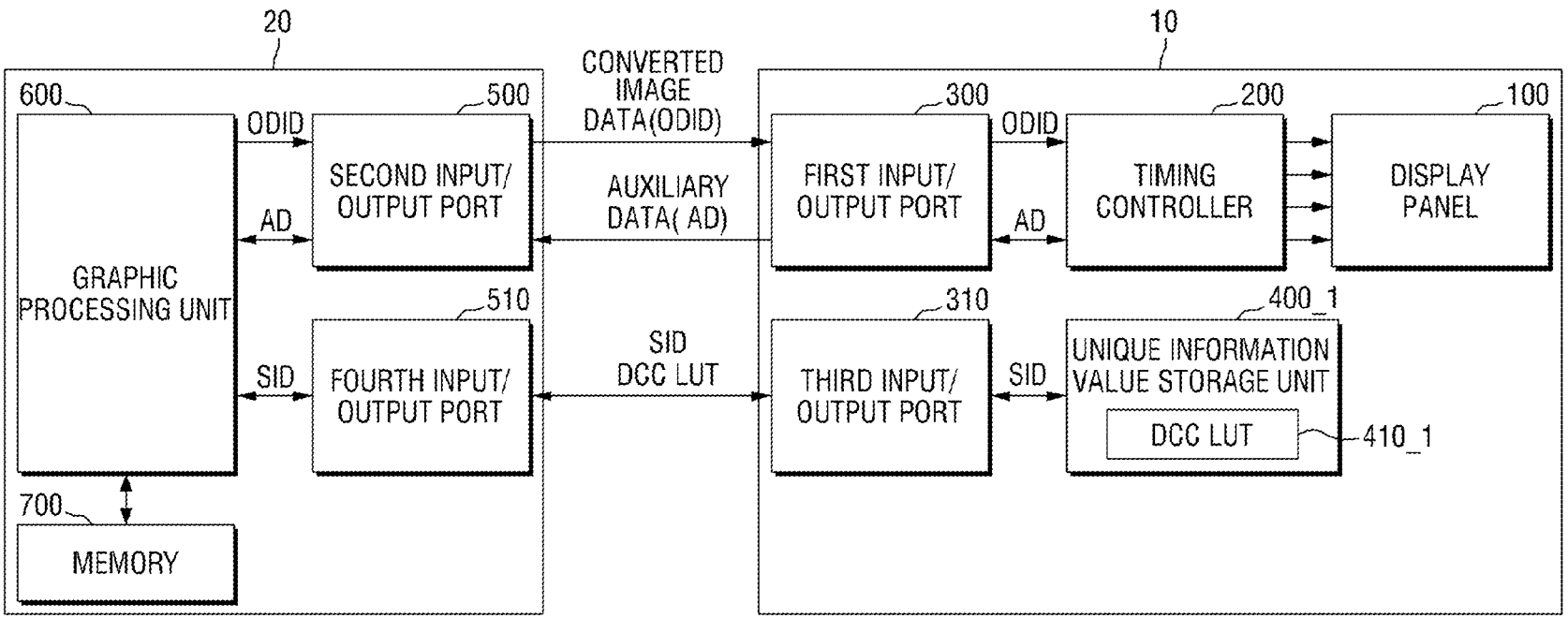
FIG. 8 is a block diagram of a display device according to another exemplary embodiment.

FIG. 8 is a block diagram of a display device according to another exemplary embodiment.

The embodiment of FIG. 8 is different from the embodiment of FIG. 1 in that the display assembly 10 includes a third input/output port 310 and the external image processing set 20 includes a fourth input/output port 510. Therefore, identical reference numerals will be given to the components substantially identical to those of FIG. 1, and iterative explanations thereof will be omitted.

The display assembly 10 may include the third input/output port 310, and the external image processing set 20 may include the fourth input/output port 510.

A unique information value storage unit 400_1 may be directly connected to the third input/output port 310, and unique information data SID stored in the unique information value storage unit 400_1 of the display assembly 10 may be transmitted to the external image processing set 20 through the third input/output port 310. Furthermore, a DCC LUT 410_1, as a part of the unique information data SID, may be transmitted to the external image processing set 20.

The fourth input/output port 510 may receive the unique information data SID and DCC LUT, and may transmit the unique information data SID and DCC LUT to the graphic processing unit 600. Alternatively, although not shown in the drawing, the unique information data SID may be stored directly in the memory 700, instead of being stored via the graphic processing unit 600.

The third input/output port 310 and the fourth input/output port 510 may be interfaces which perform a bidirectional data transmission between the external image processing set 20 and the display assembly 10, or may be ports or terminals connectible to or disconnectible from a cable connected to the external image processing set 20 and the display assembly 10. Specifically, the third input/output port 310 and the fourth input/output port 510 may be embedded display ports (EDPs), display ports (DPs), DVI ports or HDMI ports. The third input/output port 310 and the fourth input/output port 510 may be I2C connector terminals or connecting portions for a bidirectional transmission of the auxiliary channel AC.

Figure 9:
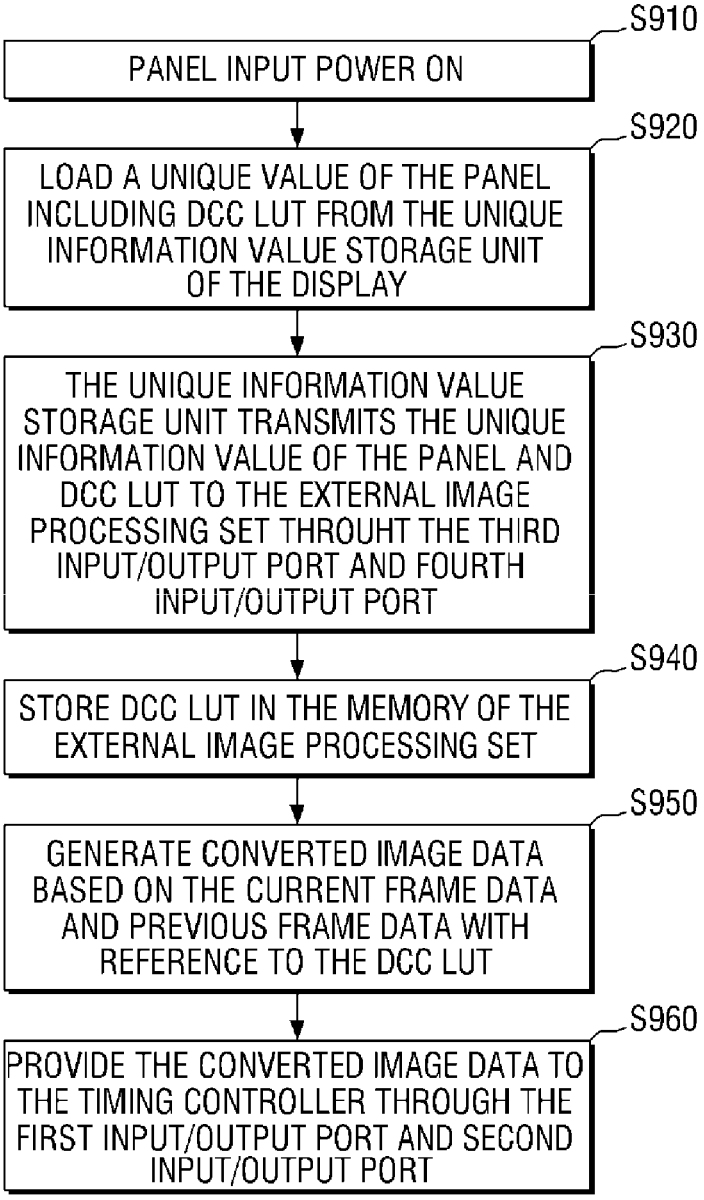
FIG. 9 is a flowchart illustrating an operation of the display device according to another exemplary embodiment.

FIG. 9 is a flow chart illustrating an operation of the display device according to another exemplary embodiment.

Referring to FIG. 9, an operation start signal is generated when power is applied to the external image processing set 20 and the display assembly 10, and accompanying initialization process for displaying image data may be performed by the display assembly 10 and the external image processing set 20 (S910).

Subsequently, the display assembly 10 may load information regarding a unique value of the display panel 100 including DCC LUT from the unique information value storage unit 400 (S920).

Subsequently, unique information data SID of the display panel 100 and DCC LUT are transmitted to the external image processing set 20 through the third input/output port 310 and the fourth input/output port 510 (S930).

Subsequently, the DCC LUT may be stored in the DCC LUT storage section 730 of the memory 700 of the external image processing set 20 (S940).

Subsequently, converted image data ODID may be generated based on the current frame data and previous frame data with reference to the DCC LUT (S950).

Subsequently, the converted image data ODID may be provided to the timing controller 200 through the first input/output port 300 and the second first input/output port 500 to display an image which has undergone dynamic capacitance compensation (S960).

Figure 10:
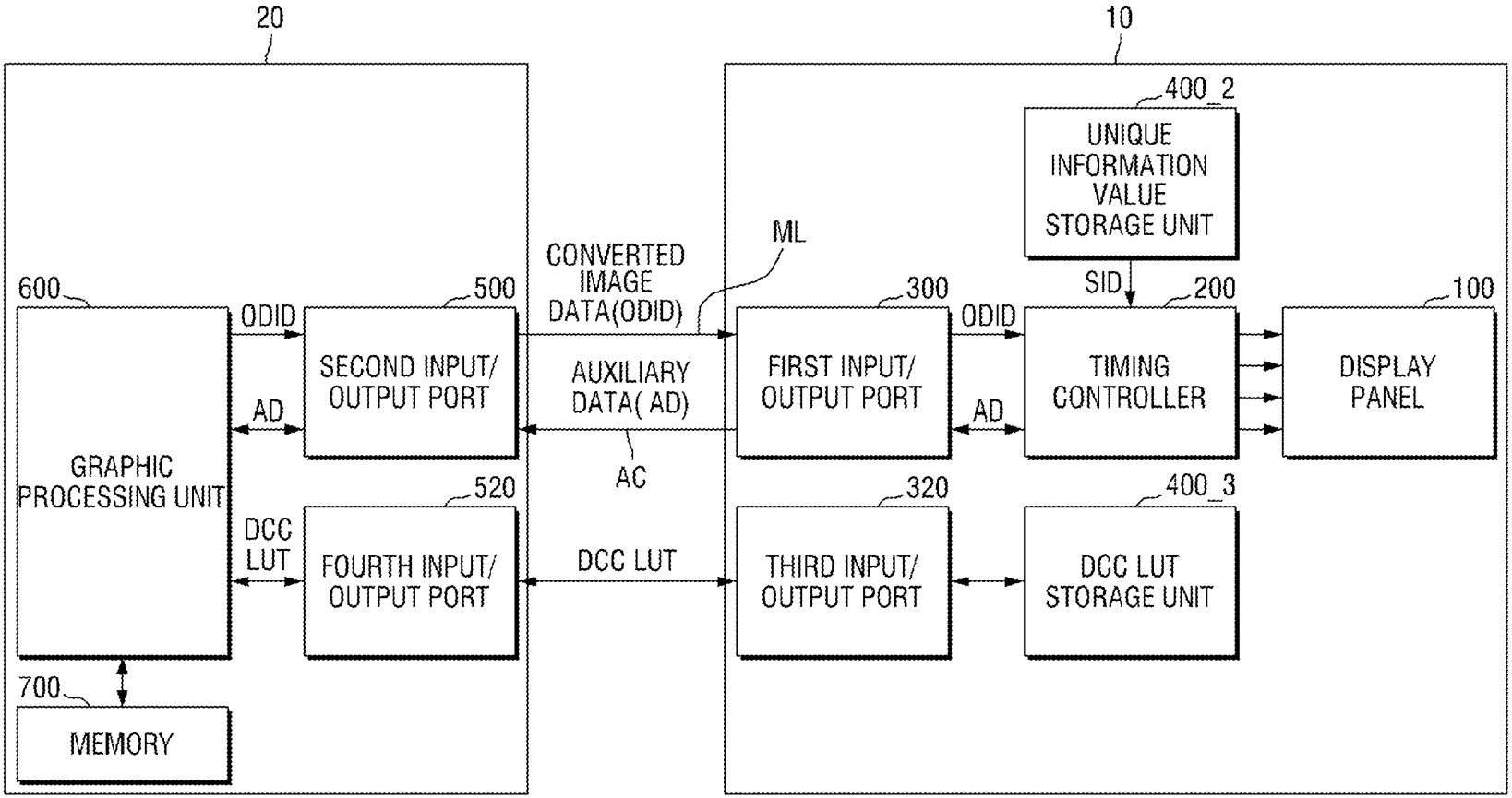
FIG. 10 is a block diagram of the display device according to yet another exemplary embodiment.

FIG. 10 is a block diagram of the display device according to yet another exemplary embodiment.

The embodiment of FIG. 10 is different from the embodiment of FIG. 1 in that the display assembly 10 includes a third input/output port 320 and the external image processing set 20 includes a fourth input/output port 520, and a DCC LUT storage unit 400_3 is separated from a unique information value storage unit 400_2. Therefore, identical reference numerals will be given to the components substantially identical to those of FIG. 1, and iterative explanations thereof will be omitted.

The display assembly 10 may include the third input/output port 320 and the external image processing set 20 may include the fourth input/output port 520.

The unique information value storage unit 400_2 may be connected to the timing controller 200 to provide unique information data SID to the timing controller 200.

The DCC LUT storage unit 400_3 may be separated from the unique information value storage unit 400_2, and may be directly connected to the third input/output port 320 differently from the unique information value storage unit 400_2, and may transmit DCC LUT to the external image processing set 20 through the third input/output port 320.

The fourth input/output port 520 may receive the DCC LUT and may transmit the received DCC LUT to the graphic processing unit 600. Alternatively, although not shown in the drawing, the DCC LUT may be stored directly in the memory 700, and not via the graphic processing unit 600.

The third input/output port 320 and the fourth input/output port 520 may be interfaces which perform a bidirectional data transmission between the external image processing set 20 and the display assembly 10, or may be ports or terminals connectible to or disconnectible from a cable connected to the external image processing set 20 and the display assembly 10. Specifically, the third input/output port 320 and the fourth input/output port 520 may be embedded display ports (EDPs), display ports (DPs), DVI ports or HDMI ports. The third input/output port 320 and the fourth input/output port 520 may be I2C connector terminals or connecting portions for a bidirectional transmission of the auxiliary channel AC.

Figure 11:
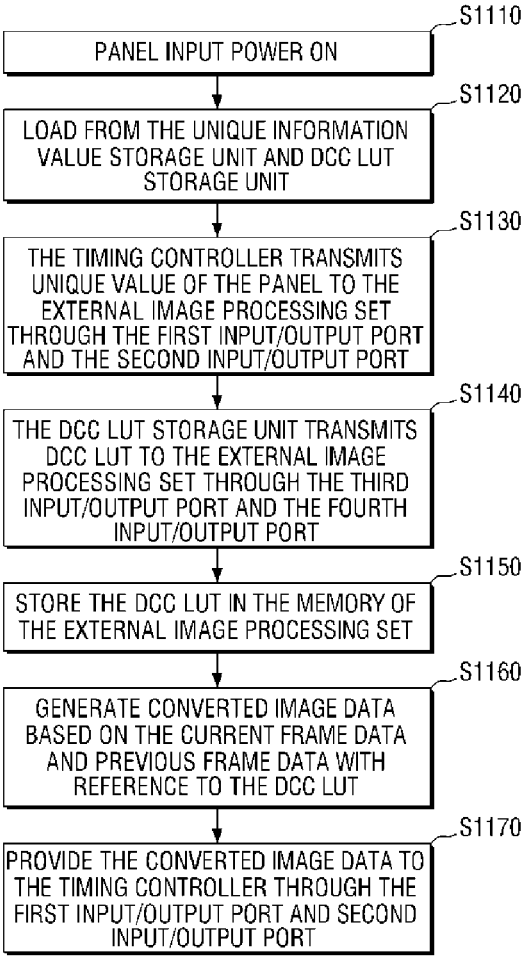
FIG. 11 is a flowchart illustrating an operation of the display device according to yet another exemplary embodiment.

FIG. 11 is a flow chart illustrating an operation of the display device according to yet another exemplary embodiment.

Referring to FIG. 11, an operation start signal is generated when power is applied to the external image processing set 20 and the display assembly 10, and accompanying initialization process for displaying image data may be performed by the display assembly 10 and the external image processing set 20 (S1110).

Subsequently, the display assembly 10 may load unique information data SID from the unique information value storage unit 400_2 and DCC LUT from the DCC LUT storage unit 400_3 (S1120).

Subsequently, the timing controller 200 may transmit unique information data SID of the display panel 100 to the external image processing set 20 through the first input/output port 300 and the second input/output port 500 (S1130).

Subsequently, the DCC LUT storage unit 400_3 may transmit DCC LUT to the external image processing set 20 through the third input/output port 320 and the fourth input/output port 520 (S1140).

Subsequently, the DCC LUT may be stored in the DCC LUT storage section 730 of the memory 700 of the external image processing set 20 (S1150).

Subsequently, converted image data ODID may be generated based on the current frame data and previous frame data with reference to the DCC LUT (S1160).

Subsequently, the converted image data ODID may be provided to the timing controller 200 through the first input/output port 300 and the second first input/output port 500 so as to display an image which has undergone dynamic capacitance compensation (S1170).

According to exemplary embodiments, a dynamic capacitance compensation method for improving response speed can be properly employed while eliminating use of the frame memory for dynamic capacitance compensation from the driving unit of the display panel.

According to exemplary embodiments, various components may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the processes described herein to facilitate image signal processing and the display of images via display device 1 may be implemented via software, hardware (e.g., general processor, Digital Signal Processing (DSP) chip, an Application Specific Integrated Circuit (ASIC), Field Programmable Gate Arrays (FPGAs), etc.), firmware, or a combination thereof. In this manner, the display device of FIG. 1 may include or otherwise be associated with one or more memories including code (e.g., instructions) configured to cause the display device 100 to perform one or more of the processes and/or features described herein.

The memories may be any medium that participates in providing code/instructions to the one or more software, hardware, and/or firmware for execution. Such memories may take many forms, including but not limited to non-volatile media, and transmission media. Non-volatile media include, for example, optical or magnetic disks. Volatile media include, for example, various types of RAM. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

an external image processing set; and a display assembly comprising:

a timing controller configured to receive converted image data from the external image processing set;

a display panel communicatively coupled to the timing controller, the display panel being configured to display an image corresponding to the converted image data; and a first memory communicatively coupled to the timing controller, the first memory comprising a dynamic capacitance compensation lookup table, wherein the external image processing set comprises:

a second memory configured to:

receive the dynamic capacitance compensation lookup table from the display assembly; and store, therein, the received dynamic capacitance compensation lookup table; and a graphics processor communicatively coupled to the second memory, the graphics processor being configured to output converted image data, the converted image data comprising current frame data that has undergone dynamic capacitance compensation based on the received dynamic capacitance compensation lookup table, the current frame data, and previous frame data.

2. The display device of claim 1, wherein:

the display assembly further comprises a first input/output port;

the external image processing set further comprises a second input/output port electrically connected to the first input/output port;

the display assembly is configured to transmit the dynamic capacitance compensation lookup table to the external image processing set through the first input/output port; and the external image processing set is configured to receive the dynamic capacitance compensation lookup table through the second input/output port.

3. The display device of claim 2, wherein the first input/output port and the second input/output port comprise:

a main link configured to transmit the converted image data from the external image processing set to the display assembly; and an auxiliary channel configured to perform bidirectional transmission of auxiliary data between the external image processing set and the display assembly.

4. The display device of claim 3, wherein the first input/output port and the second input/output port each comprise at least one of an embedded display port, a display port, a digital visual interface (DVI) port, a high definition multimedia interface (HDMI) port, and an inter-integrated circuit (I2C) connector terminal.

5. The display device of claim 1, wherein the external image processing set is physically separate from the display assembly.

6. The display device of claim 1, wherein:

the first memory is a nonvolatile memory; and the second memory is a volatile memory.

7. The display device of claim 1, wherein:

the display assembly is configured to store unique information data regarding characteristics of the display assembly; and the timing controller is further configured to:

process the received converted image data; and provide processed converted image data to the display panel.

8. The display device of claim 7, wherein:

the display assembly further comprises a first input/output port;

the external image processing set further comprises a second input/output port electrically connected to the first input/output port;

the first memory further comprises the unique information data; and the timing controller is configured to transmit the dynamic capacitance compensation lookup table of the first memory to the external image processing set through the first input/output port; and the external image processing set is configured to receive the dynamic capacitance compensation lookup table through second input/output port.

9. The display device of claim 8, wherein the first input/output port and the second input/output port comprise:

a main link configured to transmit the converted image data from the external image processing set to the display assembly; and an auxiliary channel configured to perform bidirectional transmission of auxiliary data between the external image processing set and the display assembly.

10. The display device of claim 7, wherein:

the display assembly further comprises a first input/output port and a third input/output port;

the external image processing set further comprises:

a second input/output port electrically connected to the first input/output port; and a fourth input/output port electrically connected to the third input/output port;

the first memory further comprises the unique information data;

the display assembly is configured to transmit the dynamic capacitance compensation lookup table to the external image processing set through the third input/output port; and the external image processing set is configured to receive the dynamic compensation lookup table through the fourth input/output port.

11. The display device of claim 10, wherein the first input/output port and the second input/output port comprises:

a main link configured to transmit the converted image data from the external image processing set to the display assembly; and an auxiliary channel configured to perform bidirectional transmission of auxiliary data between the external image processing set and the display assembly.

12. The display device of claim 7, wherein:

the display assembly further comprises a first input/output port and a third input/output port;

the external image processing set further comprises:

a second input/output port electrically connected to the first input/output port; and a fourth input/output port electrically connected to the third input/output port;

the timing controller is configured to receive the unique information data;

the display assembly is configured to transmit the dynamic capacitance compensation lookup table to the external image processing set through the third input/output port; and the external image processing set is configured to receive the dynamic capacitance compensation lookup table through the fourth input/output port.

13. The display device of claim 12, wherein the first input/output port and the second input/output port comprise:

a main link configured to transmit the converted image data from the external image processing set to the display assembly; and an auxiliary channel configured to perform bidirectional transmission of auxiliary data between the external image processing set and the display assembly.

14. The display device of claim 13, wherein the first input/output port and the second input/output port each comprise at least one of an embedded display port, a display port, a digital visual interface (DVI) port, a high definition multimedia interface (HDMI) port, and an inter-integrated circuit (I2C) connector terminal.

15. The display device of claim 1, wherein:

the external image processing set comprises a memory controller; and the memory controller is configured to:

store current frame data into a frame memory of the second memory; and store the dynamic capacitance compensation lookup table in a dynamic capacitance compensation lookup table storage section of the second memory.

16. The display device of claim 15, wherein:

the graphics processor comprises dynamic capacitance compensation processing logic, the dynamic capacitance compensation processing logic comprising a dynamic capacitance compensation algorithm; and the dynamic capacitance compensation processing logic is configured to cause the graphics processor at least to:

receive, via the memory controller, previous frame data and the dynamic capacitance compensation lookup table; and output the converted image data, the previous frame data, and the dynamic capacitance compensation lookup table.

* * * * *